US009759389B2

(12) United States Patent
Bergmann et al.

(10) Patent No.: US 9,759,389 B2
(45) Date of Patent: Sep. 12, 2017

(54) LED BASED CANDELABRA LAMP

(71) Applicant: Cree, Inc., Durham, NC (US)

(72) Inventors: Michael John Bergmann, Raleigh, NC (US); David Power, Morrisville, NC (US); Scott Schwab, Durham, NC (US); Francis Wong Daw Heng, New Taipei (TW); Weng Cheng-Yao, New Taipei (TW); Chen Guang-Yi, Kunshan (TW)

(73) Assignee: Cree, Inc., Durham, NC (US)

( * ) Notice: Subject to any disclaimer, the term of this patent is extended or adjusted under 35 U.S.C. 154(b) by 167 days.

(21) Appl. No.: 14/564,228

(22) Filed: Dec. 9, 2014

(65) Prior Publication Data

US 2016/0161062 A1 Jun. 9, 2016

(51) Int. Cl.

| | |
|---|---|
| ***F21V 5/04*** | (2006.01) |
| ***F21K 99/00*** | (2016.01) |
| ***F21V 23/00*** | (2015.01) |
| ***F21K 9/23*** | (2016.01) |
| ***F21K 9/61*** | (2016.01) |
| ***F21K 9/238*** | (2016.01) |
| *F21V 3/00* | (2015.01) |
| *F21Y 115/10* | (2016.01) |

(52) U.S. Cl.

CPC ..... *F21K 9/1355* (2013.01); *F21K 9/23* (2016.08); *F21K 9/238* (2016.08); *F21K 9/61* (2016.08); *F21V 23/006* (2013.01); *F21V 3/00* (2013.01); *F21Y 2115/10* (2016.08)

(58) Field of Classification Search

CPC ..... F21K 9/1355; F21K 9/135; F21K 9/61; F21K 9/238; F21V 7/0091; F21V 5/04; F21V 3/00

See application file for complete search history.

(56) References Cited

U.S. PATENT DOCUMENTS

2006/0238136 A1* 10/2006 Johnson, III ..... F21S 6/00 315/185 R
2009/0212698 A1* 8/2009 Bailey ..... F21K 9/52 313/512
2011/0273102 A1 11/2011 Van De Ven et al.

(Continued)

OTHER PUBLICATIONS

U.S. Appl. No. 14/284,643, filed May 22, 2014.

(Continued)

*Primary Examiner* — Karabi Guharay
(74) *Attorney, Agent, or Firm* — Dennis J. Williamson; Moore & Van Allen PLLC

(57) ABSTRACT

A LED lamp has a non-optically transmissive base connected to an optically transmissive enclosure. A LED assembly emits light when energized through an electrical path from the base. A portion of the heat sink and lamp electronics extend from the base and into the enclosure such that at least an upper portion of the heat sink extends into the interior volume defined by the enclosure. The LED assembly is supported on top of the heat sink such that the LEDs are disposed in the volume of the enclosure. An optic element extends over the LEDs and at least the portion of the heat sink. The size of the non-optically transmissive base of the lamp is reduced relative to the optically transmissive enclosure such that a greater ratio of optically transmissive view space to non-optically transmissive base is provided.

34 Claims, 4 Drawing Sheets

(56) References Cited

U.S. PATENT DOCUMENTS

| | | | | |
|---|---|---|---|---|
| 2012/0161626 | A1* | 6/2012 | van de Ven | F21V 7/0016 315/35 |
| 2013/0026923 | A1 | 1/2013 | Athalye et al. | |
| 2013/0026925 | A1 | 1/2013 | Ven et al. | |
| 2013/0069535 | A1 | 3/2013 | Athalye | |
| 2013/0069547 | A1 | 3/2013 | Van De Ven et al. | |
| 2013/0119872 | A1 | 5/2013 | Chobot | |
| 2013/0127353 | A1 | 5/2013 | Athalye et al. | |
| 2013/0162149 | A1 | 6/2013 | Van De Ven et al. | |
| 2013/0162153 | A1 | 6/2013 | Van De Ven et al. | |
| 2013/0169159 | A1 | 7/2013 | Lys | |
| 2013/0293135 | A1 | 11/2013 | Hu et al. | |
| 2014/0001959 | A1 | 1/2014 | Motley et al. | |
| 2014/0043828 | A1* | 2/2014 | Yokota | F21K 9/52 362/311.02 |
| 2014/0167620 | A1 | 6/2014 | Chobot | |
| 2014/0167622 | A1 | 6/2014 | Chobot et al. | |
| 2014/0167623 | A1 | 6/2014 | Chobot et al. | |
| 2014/0167642 | A1 | 6/2014 | Chobot | |
| 2014/0167653 | A1 | 6/2014 | Chobot | |
| 2014/0268790 | A1 | 9/2014 | Chobot et al. | |
| 2015/0029733 | A1* | 1/2015 | Yoo | F21V 5/002 362/373 |

OTHER PUBLICATIONS

U.S. Appl. No. 14/052,336, filed Oct. 10, 2013.
U.S. Appl. No. 61/932,058, filed Jan. 27, 2014.
U.S. Appl. No. 14/292,286, filed May 30, 2014.
U.S. Appl. No. 29/511,241, filed Dec. 9, 2014.
Philips, 40W Equivalent Soft White (2700K) B13 Blunt Tip Candle Dimmable LED Light Bulb (4-Pack), http://www.homedepot.com/p/Philips-40W-Equivalent-Soft-White-2700K-B13-Blunt-Tip-Candle-Dimmable-LED-Light-Bulb-4-Pack-435057/205362382.
Sylvania, Ultra 6-Watt (40W Equivalent) Candelabra Base Soft White Dimmable Decorative LED Light Bulb, http://www.lowes.com/pd_592629-3-79636_0_?productId=50222729.
TCP, 40W Equivalent Soft White (2700K) B10 Candelabra Dimmable LED Light Bulb (3-Pack), http://www.homedepot.com/p/TCP-40W-Equivalent-Soft-White-2700K-B10-Candelabra-Dimmable-LED-Light-Bulb-3-Pack-RLDCT527KC3/205688945?N=5yc1vZbm79Z1z0u2lw.
Lextar Electronics Corporation, PC55H04 Product Specification, 2010.

* cited by examiner

LED BASED CANDELABRA LAMP

BACKGROUND

Light emitting diode (LED) lighting systems are becoming prevalent as replacements for older lighting systems. LED systems are an example of solid state lighting (SSL) and have advantages over traditional lighting solutions, such as incandescent and fluorescent lighting, because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a lamp.

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting the supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

One type of traditional lighting system is an incandescent bulb that typically comprises a wire filament or filaments supported in a glass enclosure. Wires extend between the bulb's base and the filament to provide electric current from the base to the filament. The filament heats and glows to emit usable light. Incandescent bulbs typically have a base with an Edison connector, or other style of connector, that is connected to the enclosure where the enclosure may have a variety of shapes and sizes.

SUMMARY

In some embodiments a LED candelabra comprises a non-optically transmissive base. A LED assembly emits light when energized through an electrical path from the base. The LED assembly is arranged to a first side of a plane that is disposed substantially transverse to a longitudinal axis of the candelabra. An optically transmissive enclosure is connected to the base and has a first end extending to a second side of the plane. An optic element in the enclosure receives the light emitted by the LED assembly. The optic element comprises a first portion that extends to the first side of the plane for transmitting light from a light emitting portion and a second portion that extends to the second side of the plane.

The base may comprise an Edison base. The light emitting portion may comprise surface treatment on the optic element. The light emitting portion may be configured to visually appear like a filament in a traditional bulb. The LED assembly may be thermally coupled to a heat sink. The heat sink may define a cavity for receiving lamp electronics. The optically transmissive enclosure may be connected to the base at a second plane that is disposed transverse to the longitudinal axis. A portion of the heat sink and a portion of the lamp electronics may extend from the base beyond the second plane. An upper portion of the heat sink may extend beyond an upper end of the base. The optic element may extend over the LED assembly and at least the portion of the heat sink. The portion of the heat sink may comprise a LED support surface for supporting the LED assembly. A portion of the optic element may be disposed between the LED support surface and the enclosure. The enclosure may define an interior space and the optic element may divide the interior space of the enclosure from the base. A portion of the enclosure may extend from the first side of the plane to the second side of the plane.

In some embodiments a LED lamp comprises a non-optically transmissive base. An optically transmissive enclosure is connected to the base where a plane separates the base from the enclosure. An LED assembly emits light when energized through an electrical path from the base. The LED assembly is arranged to a first side of the plane. An optic element in the enclosure receives the light emitted by the LED assembly. The optic element comprises a first portion that extends to the first side of the plane. A cavity in the base receives lamp electronics where the cavity extends beyond the plane.

The LED assembly may be arranged to a first side of a second plane where the second plane may be parallel to the first plane. The optic element may comprise a first portion that extends to the first side of the second plane and a second portion that extends to a second side of the second plane. The LED assembly may be thermally coupled to a heat sink where the heat sink defines the cavity for receiving the lamp electronics. A portion of the heat sink and a portion of the lamp electronics may extend from the base beyond the plane. The optic element may extend over the LED assembly and at least the portion of the heat sink. The heat sink may comprise a LED support surface for supporting the LED assembly and a portion of the optic element may be disposed between the LED support surface and the enclosure. The optic element may divide the interior space of the enclosure from the base. A portion of the enclosure may extend from the first side of the second plane to the second side of the second plane.

In some embodiments a LED candelabra comprises a base and a LED assembly for emitting light when energized through an electrical path from the base. The LED assembly comprises single SMD LED component. An optically transmissive enclosure connected to the base. An optic element is in the enclosure for receiving the light emitted by the LED assembly. The optic element comprises a stem having a first width and a base having a second width where the second width is at least three times greater than the first width.

The second width may be approximately between three times and 10 times the first width. The stem may have a height where the height of the stem and the width of the optic element at the distal end may have a height to width ratio of at least 2:1. A light emitting portion may be formed on the stem. The stem may have a width of less than 5 mm at a distal end of the stem. The surface area of the single SMD LED has a single light emitting surface. The lamp may produce a CRI≥90 and a R9 value≥40. The optic element may be formed as a relatively long, thin member that is disposed along the longitudinal axis of the lamp. The lamp may emit light having a color temperature of between 1500K and 6500K. The single SMD LED component may be centered relative to the optical element. The light may be emitted with a periodic or aperiodic oscillation of intensity. The oscillation of intensity may have a frequency of amplitude change in the range of approximately 5 and 60 Hz. The stem may have a height to width ratio of between approximately 2:1 and 8:1. The stem may terminate in an end face where a recess is formed in the end face. A wireless module may be provided in the lamp for receiving and/or transmitting a radio signal.

DETAILED DESCRIPTION

Figure 1:
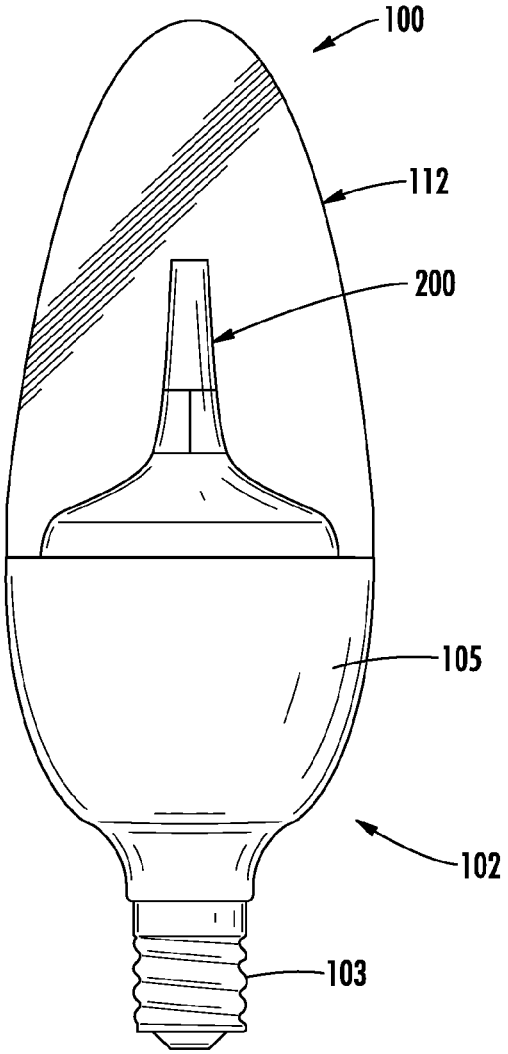
FIG. 1 is a side view of an embodiment of a LED lamp of the invention.
Figure 2:
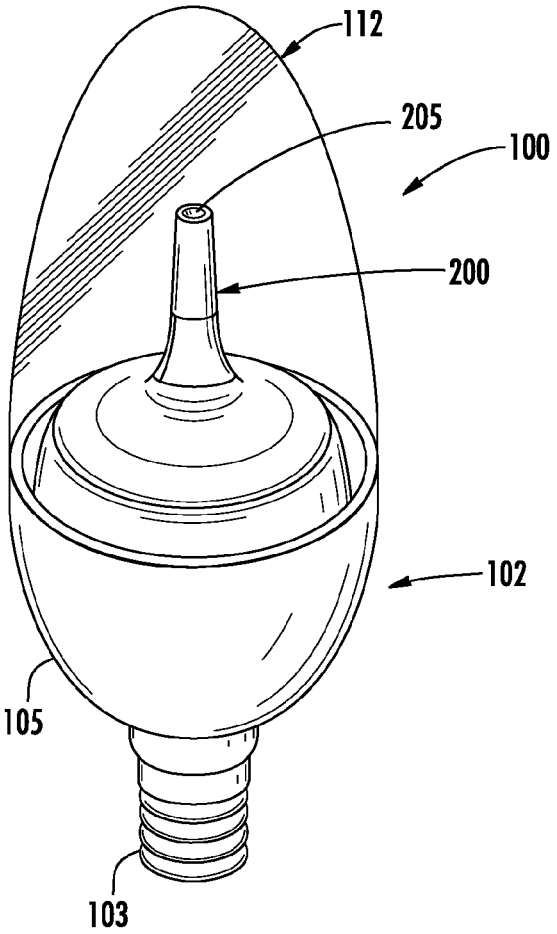
FIG. 2 is a perspective view of the lamp of FIG. 1.
Figure 3:
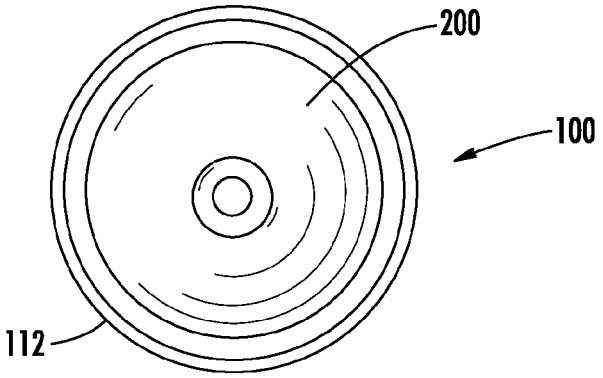
FIG. 3 is a top view of the lamp of FIG. 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

In a traditional incandescent bulb a filament, such as a tungsten filament, may be supported by support wires secured to or embedded in a glass stem where the stem extends from the bulb base into an optically transmissive enclosure such as a glass globe. The support wires may position the filament at the approximate center of the enclosure. The light is projected substantially uniformly over the surface of the enclosure, although some variation in the dispersion of light over the surface area of the enclosure may occur. Such filaments may assume a variety of shapes such as multiple loops, cage style, spiral, hairpin or the like. In traditional incandescent bulbs current is delivered to the filament or filaments by electrical wires that extend from the electrically conductive base and are connected to the filament(s). The electrical wires may also serve as the physical support for the filament(s). Electrical current is passed through the filament(s) causing the filament to heat and produce visible light. The filament(s) may be visible during operation of the bulb as a glowing component, especially when the bulb is dimmed. When low current is passed through the filament, such as in a dimmer application, the filament may glow as yellow-orange-red light.

The LED lamp of the invention uses an LED light source that has the visual appearance of a traditional incandescent bulb. In some embodiments, the lamp has a connector such as an Edison screw that may be connected to a source of power, such as an Edison socket. In other embodiments the lamp may comprise an LED light source connected to a bayonet-style base that may be inserted into a bayonet-style socket. In a bayonet-style connector the lamp base comprises external lugs where the base and socket are configured to correspond to, and to have the external appearance of, standard bayonet connectors. Typically, in a standard bayonet connector the base is inserted into the socket and is rotated a partial turn to engage the lugs with lug receptacles in the socket. Standard Edison screws and bayonet connectors come in a variety of sizes. The Edison screw and bayonet connector may both provide the physical connection between the lamp and the fixture and form part of the electrical path for providing current from a power source to the LEDs. The lamp comprises an internal optic element that is configured such that the optic element emits light in a visible pattern that has a visual appearance that mimics the light pattern emitted by a glowing incandescent filament of a traditional incandescent bulb.

Some traditional lights are intended to be used as candelabra bulbs. Candelabra bulbs refer to small base incandescent bulbs that are intended to be used in decorative light fixtures such as chandeliers, ceiling fans and other decorative fixtures to provide light and a decorative lighting effect. Candelabra bulbs are typically defined by a smaller size than the traditional standard incandescent bulb and may use, for example, an E12 Edison base rather than a larger E26 base, for example. In bulb nomenclature the E represents an Edison base and the number represents the base diameter in millimeters. Moreover, the optically transmissive enclosure in a candelabra bulb is typically smaller than in a classic incandescent bulb where the most common standard incandescent bulb may be defined by the ANSI standard A19 where the number represents the diameter of the enclosure in eighths of an inch. Candelabra bulbs may be designated, for example, a B-series or C-series bulb such as C7 or C15. The shape of the enclosure in a candelabra bulb tends to have a narrower and more elongated profile than the "globe" shape of a traditional A-series bulb. As a result the interior space of a candelabra bulb is significantly smaller than the interior space of a typical A-series bulb. Because of the relatively small interior space of a candelabra bulb, incorporating LED technology into a candelabra size lamp while maintaining the traditional smaller form factor of the lamp poses problems. As used herein a candelabra lamp means a lamp having base that may be 15 mm in diameter or smaller depending upon the type of base used. In an Edison base a candelabra lamp means a lamp having an E12 base or smaller base. For a bayonet base a candelabra lamp means a lamp having a BA15 base or smaller base. While the lamp of the invention has particular applicability to candelabra lamps the lamp of the invention may be used in any size and style of lamp.

FIGS. 1 through 5 show a lamp 100 according to an embodiment of the present invention. Lamp 100 is shown having a candelabra form factor that may be similar to the form factor of a legacy incandescent candelabra bulb, or similar style bulb, with a non-optically transmissive base 102 and an optically transmissive enclosure 112. Lamp 100 may be designed to serve as a solid-state replacement for an incandescent candelabra bulb. Lamp 100 may have other form factors and may also have the size and form factor of a larger incandescent bulb, such as a A19 bulb. The lamp 100 may conform to other standards or to other non-standard bulb form factors. Because the lamp 100 of the invention may be advantageously used to mimic the visual appearance of a traditional bulb the enclosure 112 may have a shape that conforms to traditional bulbs. The enclosure 112 is, in some embodiments, a transparent enclosure of similar shape to that commonly used in traditional incandescent candelabra bulbs and may have an elongated profile having a height that is significantly larger greater than its diameter. The enclosure 112 may be formed of glass, polycarbonate or other optically transmissive material. In some embodiments, the enclosure 112 may be coated on the inside with silica, providing a diffuse scattering layer that produces a more uniform far field pattern. It should also be noted that in this or any of the embodiments shown here, the optically transmissive enclosure 112 or a portion of the optically transmissive enclosure could be coated or impregnated with phosphor. Because the lamp as described herein may be used to mimic the appearance of traditional incandescent candelabra bulbs, the enclosure 112 may have a form factor that corresponds to the size and shape of a traditional candelabra bulb and the enclosure 112 may be transparent such that the glowing optic element 200 is visible through the enclosure 112. The enclosure 112 may also be made of a transparent colored material.

Figure 4:
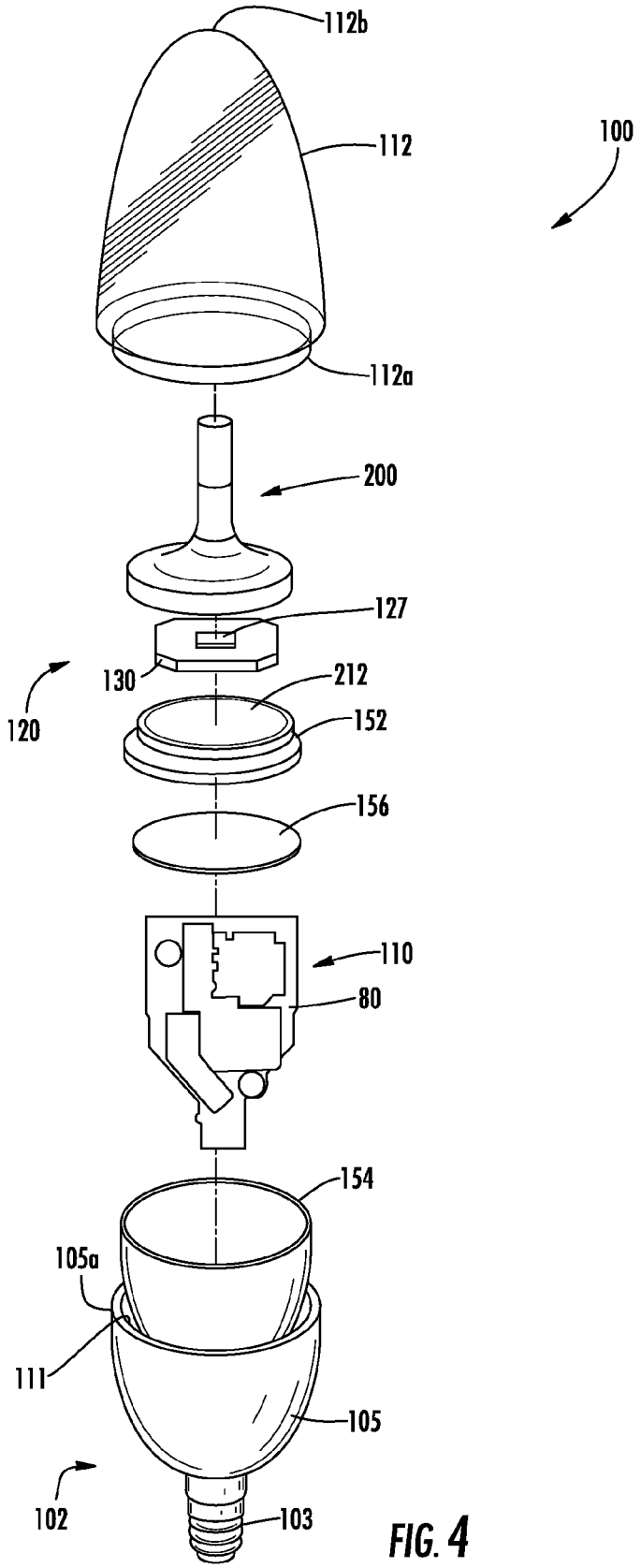
FIG. 4 is an exploded view of the lamp of FIG. 1.
Figure 5:
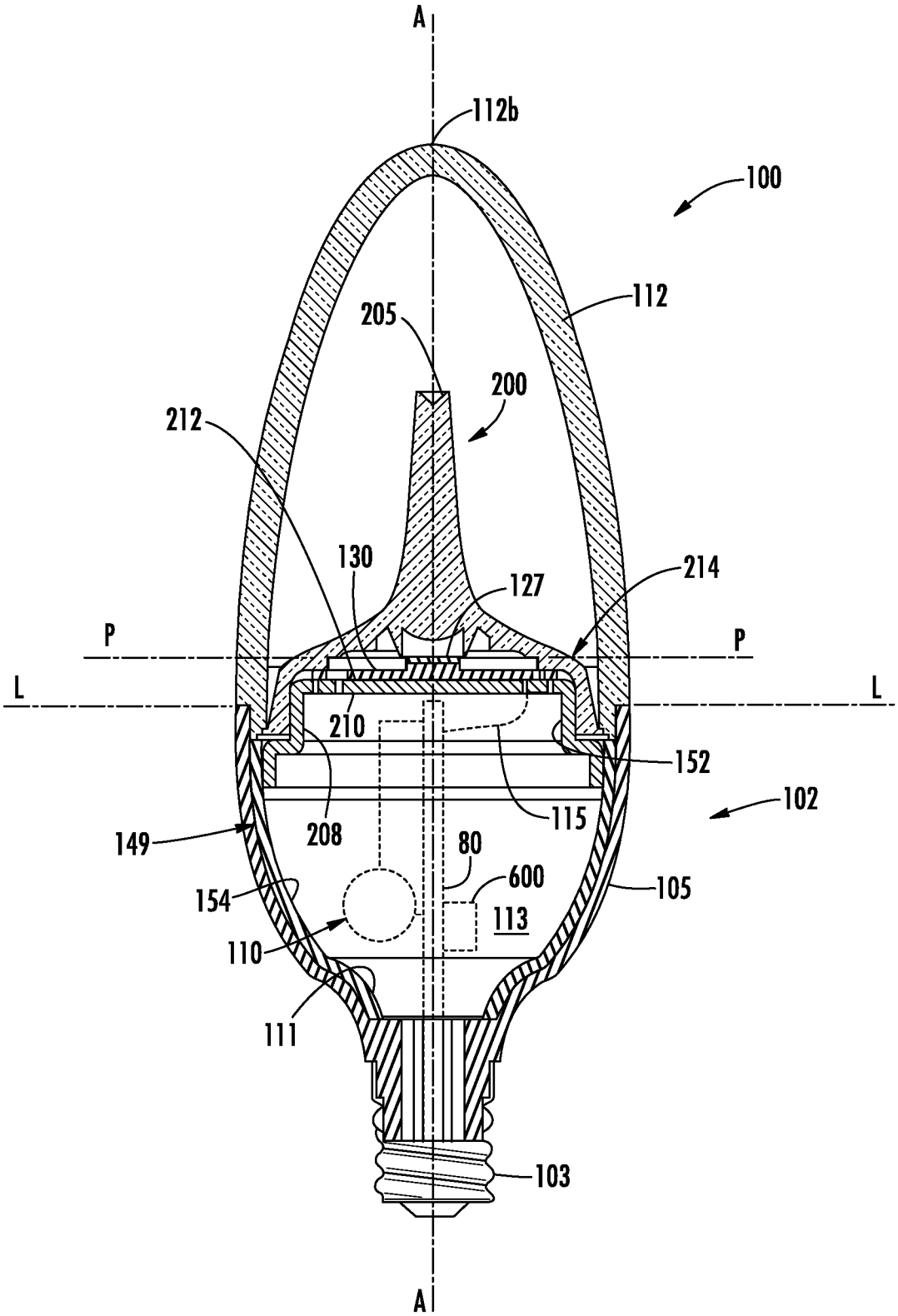
FIG. 5 is a section view of the lamp of FIG. 1.

Referring to FIGS. 4 and 5, the LED lamp is shown comprising a LED assembly 120 provided with light emitting LEDs and/or LED packages where multiple LEDs may be used together, forming an LED array. The LED light source is referred to herein as LED 127. The LED 127 can be mounted on or fixed within the lamp in various ways. In at least some example embodiments, a LED board 130 may be used to support the LED 127 and to form part of the electrical path to the LEDs. The LED board 130 may comprise a PCB, MCPCB, flex circuit, lead frame structure, flexible PCB or other similar structure. The LED 127 may comprise one or more LED dies disposed in an encapsulant such as silicone, and LEDs which may be encapsulated with a phosphor to provide local wavelength conversion. A wide variety of LEDs and combinations of LEDs may be used.

In one embodiment the LED 127 comprises a single SMD LED component. The single surface mount SMD LED component may comprise one or more LED chips packaged in a single surface mount package having a single light emitting surface (LES). One suitable LED 127 is manufactured and sold by Lextar Electronics Corporation under the Part Number PC55H04 although other suitable components may be used. The Lextar LED is described in "PC55H04

Product Specification", copyright 2010 to Lextar Electronics Corp. which is incorporated by reference herein in its entirety.

With respect to the features of the LED assembly and related electronic described herein with various example embodiments of a lamp, the features can be combined in various ways. For example, the various methods of including phosphor in the lamp can be combined and any of those methods can be combined with the use of various types of LED arrangements such as bare die versus encapsulated or packaged LED devices. The embodiments shown and described herein are examples only and are intended to be illustrative of various design options for a LED lighting system.

LEDs and/or LED packages used with embodiments of the invention and can include light emitting diode chips that emit different hues of light that, when mixed, are perceived in combination as white light. Phosphors can be used as described to add yet other colors of light by wavelength conversion. For example, blue or violet LEDs can be used in the LED assembly of the lamp with the appropriate phosphor. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light. LED 127 may be individually encapsulated, each in a package with its own lens. Such embodiments can produce light with a CRI of at least 70, at least 80, at least 90, or at least 95. In one embodiment the lamp described herein produces a CRI≥90 and a R9 value≥40.

A lighting system using the combination of BSY and red LED devices referred to above to make substantially white light can be referred to as a BSY plus red or "BSY+R" system. In such a system, the LED devices used include LEDs operable to emit light of two or more different colors. A further detailed example of using groups of LEDs emitting light of different wavelengths to produce substantially while light can be found in issued U.S. Pat. No. 7,213,940, which is incorporated herein by reference.

With the embodiment of FIGS. 1 through 5, as with many other embodiments of the invention, the term "electrical path" can be used to refer to the entire electrical path to the LED 127, including an intervening power supply disposed between the electrical connection that would otherwise provide power directly to the LEDs and the LEDs, or it may be used to refer to the connection between the mains and all the electronics in the lamp, including the power supply. The term may also be used to refer to the connection between the power supply and the LEDs.

The optically non-transmissive base 102 may be connected to the enclosure 112 where the base retains the lamp electronics and functions as the physical and electrical connector to connect the lamp 100 to a corresponding socket. The base 102 may comprise an Edison base with an Edison screw 103 that comprises threads that engage an Edison socket such that the base 102 may be screwed into the socket in the same manner as a standard Edison screw. In one embodiment the base 103 is an E12 base or smaller size. Depending on the embodiment, other base configurations are possible to make the electrical connection such as other traditional-style bases. For example, a bayonet-style connector may be used that may be connected to a bayonet-style socket. A bayonet connector is inserted into the socket such that lugs engage slots in the socket. The base is then rotated a partial turn to lock the lugs in the slots. The bayonet or Edison connector provides the physical connection between the lamp 100 and the fixture and may form part of the electrical path to the LED 127.

The base 102 may comprise a screw 103 or a bayonet connector that may be connected to a housing 105 by adhesive, mechanical connector, welding, separate fasteners or the like. The housing 105 may be made of an electrically insulating material such as plastic. In some embodiments the housing 105 may comprise a thermally conductive material where heat may be dissipated from the lamp in part using the housing 105. The housing 105 terminates in an upper end 105*a* that is connected to the lower end 112*a* of the enclosure 112 such that a first interior volume of the lamp is defined by the base 102 between the connector 103 and the upper end 105*a* and a second interior volume of the lamp is defined by the enclosure 112 between the lower end 112*a* and the distal end of the lamp 112*b*. The line L-L in FIG. 5 represents the transverse plane dividing the interior volume of the optically transmissive enclosure 112 from the interior volume of the non-optically transmissive base 102. The line L-L is disposed substantially perpendicular to the longitudinal axis of the lamp A-A where the longitudinal axis A-A extends from the base 103 to the distal end of the lamp 112*b*. The interior volume defined by the enclosure 112 is optically transmissive such that light from the LED 127 may be emitted from the lamp from this volume. The interior volume defined by the base 102 is optically non-transmissive such that light is not emitted from this volume. In the illustrated embodiment the enclosure 112 extends beyond plane L-L slightly to provide a connector to the base 102; however, the base 102 overlays the enclosure 112 in this area such that the base L-L divides the optically transmissive portion of the lamp from the non-optically transmissive portion of the lamp.

The housing 105 and the Edison screw 103 (or bayonet connector) define an internal cavity 111 for receiving the electronics 110 of the lamp including the power supply and/or drivers or a portion of the electronics for the lamp. The lamp electronics 110 are electrically coupled to the Edison screw 103 such that the electrical connection may be made from the Edison screw 103 to the lamp electronics 110. The lamp electronics may be mounted on a printed circuit board 80 which includes the power supply, including large capacitor and EMI components that are across the input AC line along with the driver circuitry as described herein. The base may be potted to protect and isolate the lamp electronics 110. Electrical conductors 115 run between the lamp electronics 110 and the LED 127 to carry both sides of the supply to provide critical current to the LED 127.

In some embodiments, the lamp electronics 110 comprise a driver and/or power supply that are positioned partially in the base 102 as shown. Base 102 may include the power supply or driver and form all or a portion of the electrical path between the mains and the LED 127. The base 102 may also include only part of the power supply circuitry while some smaller components reside with the LED assembly 120. In one example embodiment, the inductors and capacitor that form part of the EMI filter are in the base. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments"

which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Examples of boost topologies are described in U.S. patent application Ser. No. 13/462,388, entitled "Driver Circuits for Dimmable Solid State Lighting Apparatus", filed on May 2, 2012 which is incorporated by reference herein in its entirety; and U.S. patent application Ser. No. 13/662,618, entitled "Driving Circuits for Solid-State Lighting Apparatus with High Voltage LED Components and Related Methods", filed on Oct. 29, 2012 which is incorporated by reference herein in its entirety. Other embodiments are possible using different driver configurations or a boost supply at lower voltages. The AC to DC conversion may also be provided by a buck topology or SEPIC topology. Other embodiments are possible using different driver configurations.

In some embodiments the driver circuit may have an input configured to be coupled to a power source, such as a phase cut dimmer, that provides a varying voltage waveform. The driver may include electromagnetic interference suppression electronics to reduce noise in the driver. One such suitable electronics is shown and described in U.S. patent application Ser. No. 14/284,643, entitled "Lighting apparatus with Inductor Current Limiting for Noise reduction", filed on May 22, 2014, which is incorporated by reference herein in its entirety.

Referring again to the figures, the LED assembly 120 may be thermally coupled to a heat sink. In some embodiments the LED board 130 is mounted on or to the heat sink 149. The LED board may be mounted directly on the heat sink or intermediate layers such as a layer of thermal adhesive may be used provided that the LED assembly is efficiently thermally coupled to the heat sink. The heat sink 149 may comprise a first portion 152 and a second portion 154 as shown for example in FIGS. 4 and 5. In one embodiment the heat sink 149 is made of a thermally conductive material such as aluminum, zinc or the like. The heat sink 149 may be made of any thermally conductive material or combinations of thermally conductive materials.

The first portion 152 is dimensioned and configured to make good thermal contact with the LED assembly 120 such that heat generated by the LED assembly 120 may be efficiently transferred to the heat sink 149. The second portion 154 comprises a cup shaped member that fits within the housing 105 and comprises an internal cavity 113 for receiving the board 80 and lamp electronics 110. The second portion 154 is in good thermal contact with the first portion 152 such that heat conducted away from the LED assembly 120 by the first portion 152 may be efficiently transferred to the second portion 154 and dissipated from the lamp 100. The heat sink 149 may have any suitable shape and configuration. A Mylar shield 156 may be located between the first portion 152 of the heat sink and the lamp electronics 110. To assemble the base, the second portion 154 of the heat sink may be positioned in housing 105. The electronics 110 may be positioned in the second portion 154 and an electrical connection may be made to Edison connector 103. The first portion 152 of the heat sink may be assembled to the second portion to complete the heat sink such that the lamp electronics 110 are located inside of the heat sink 149. An electrical connection is made from the lamp electronics 110 to the LED assembly 120.

The lamp 100 comprises an optic element 200 that is configured and positioned in the enclosure 112 such that it occupies approximately the same position as the glowing filament of a traditional incandescent bulb. The optic element 200 functions as a light guide or wave guide (hereinafter "wave guide") to transmit light from the LED 127 to a light emitting portion 202 and to emit the light from the optic element 200. The optic element 200 may be configured and located in the area defined by the glowing filament in a traditional incandescent bulb such that the light emitting portion 202 of the optic element 200 is configured in the lamp to have a visual appearance that is similar to or mimics the glowing filament of an incandescent bulb. The optic element 200 may be made of acrylic or other moldable optically transmitting plastic, other plastic material, glass or other light transmitting material. In one embodiment the optic element 200 is transparent. In one embodiment the optic element 200 may be a solid piece of material. Alternatively the optic element 200 may be formed as a hollow elongated member with an interior cavity that extends for the length of the elongated member. A single member may be used to make the optic element 200 or the optic element 200 may be made of a plurality of separate members. Light generated by the LED 127 is directed into the optic element 200 such that light may be transmitted through the optic element 200 to a light emitting portion 202 that emits light from the optic element 200 such that it is visible from the exterior of the lamp through the enclosure 112. The LED 127 may transmit light directly into the optic element 200 or a lens or other optical device may be provided that transmits light from the LED 127 to the optic element 200. In some embodiments a mixing chamber may be used to mix the light from the LED 127 before the light enters the optic element 200.

Figure 6:
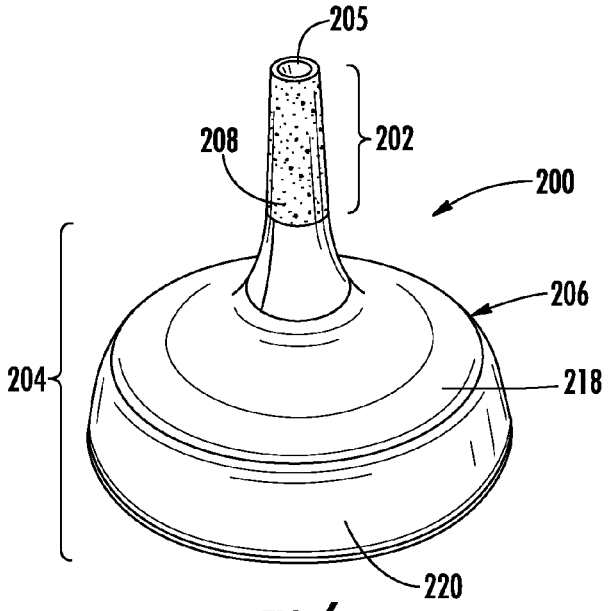
FIG. 6 is a top perspective view of an embodiment of an optic element used in the lamp of the invention.
Figure 7:
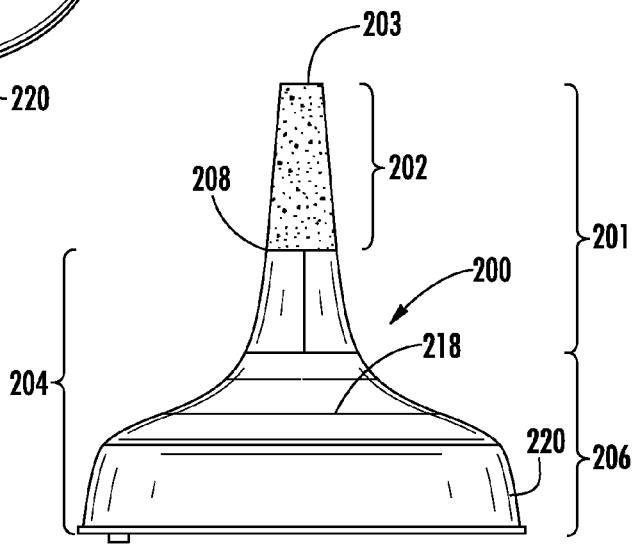
FIG. 7 is a side view of the optic element of FIG. 6.
Figure 8:
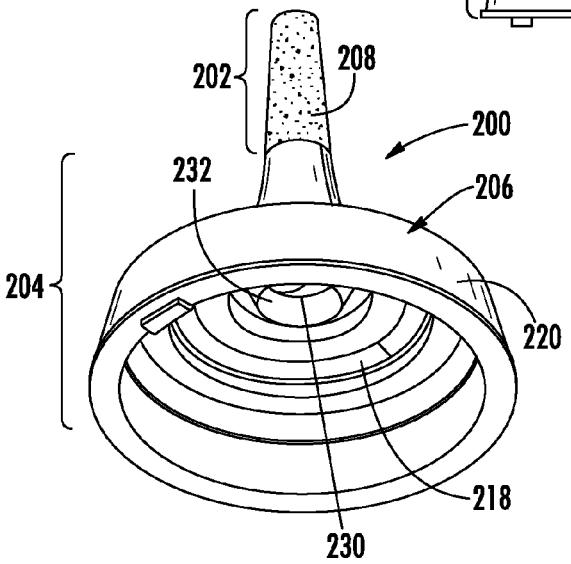
FIG. 8 is a bottom perspective view of the optic element of FIG. 6.

Referring more particularly to FIGS. 6-8, the optic element 200 is configured such that the light received from the LED 127 is emitted in a pattern that visually appears similar to or that mimics the light as it appears from the glowing filament of a traditional incandescent bulb. The optic element may be made of a transparent material with a light transmission≥90% such as Poly(methyl methacrylate) (PMMA). Light is transmitted along the length of the optic element 200. The optic element 200 may use total internal reflection to transmit the light along the length of the optic element. The optic element comprises a relatively wide base 206 and a relatively narrow stem 201 that extends from the base. The optic element may be generally cylindrical in shape. The optic element 200 comprises a light emitting portion 202 that defines the "filament portion" of the optic element 200 that emits and diffuses the light from the optic element 200. The light emitting portion 202 may be formed as part or all of the relatively narrow stem 201. In some embodiments approximately the top half of the stem 201 adjacent the distal end 203 may comprise the light emitting portion 202 while in some embodiments the top third of the stem adjacent the distal end 203 may comprise the light emitting portion. In other embodiments the light remitting portion may be spaced from the distal end 203 of the stem. A dimple or recess 205 may be formed in the end face of the stem 201. The dimple reduces shadow at the distal end of the lamp to create a more uniform far field pattern. The dimple may be formed as a concave cone. The light emitting portion 202 may comprise a notched, roughened or irregular surface, or other surface treatment (represented by the dotted area in the Figures) that causes the light to be emitted from the optic element 200 in random directions such that the light undergoes diffusion or scattering. The surface treatment of the light emitting portion 202 may be provided by scratching, etching or otherwise treating the optic element 200. Alternatively the surface treatment of the light emitting portion 202 may be provided during formation of the optic element 120 such as by creating a micro-pattern during a molding process of the optic. The term "surface treatment" is used to mean a configuration of the light emitting portion 202 of the optic element 200 that allows light to be refracted and transmitted across a boundary such that the light is transmitted from the optic element and typically includes light scattering or diffusing properties. The "surface treatment" may comprise "surface indentations" where the "surface indentation" means a treatment of the optic element that creates surface irregularities that cause light to be emitted from the optic element such as etching, roughening, molding of irregularities or the like.

The optic element 200 may also include non-light emitting portions 204 in those areas where less light is emitted from the optic element. The non-light emitting portions 204 may serve as light paths between the LED 127 and the light emitting portions 202 of the optic element 200 such that the light is more visible in the areas 202 that correspond to the illuminated filament in a traditional incandescent bulb. For example the non-light emitting portions 204 of the optic element 200 may not comprise the surface treatments described above.

Because of the relatively limited internal volume of a candelabra lamp as explained previously, in order to make a LED lamp having the form factor of a candelabra, a portion of the heat sink 149 and lamp electronics 110 extend from the base 102 beyond plane L-L and into the enclosure 112. The lamp is configured such that the internal cavity 113 for receiving the lamp electronics 110 extends beyond the lower end 112*a* of the enclosure 112 and to the opposite side of plane L-L from base 102. As shown in FIG. 5 at least an upper portion of the heat sink 149 extends beyond the upper end 105*a* of the base 105 and extends beyond line L-L and into the interior volume defined by the optically transmissive enclosure 112. The LED 127 and LED board 130 are supported on top of the heat sink 149 such that the LED 127 and LED board are disposed in the volume of the enclosure 112 to the side of plane L-L opposite base 102. As shown in FIG. 5 the LED 127 are located in the enclosure 112 approximately at plane P-P, or above plane P-P, to the side of plane P-P opposite base 102. The plane P-P is disposed substantially perpendicular to longitudinal axis A-A and parallel to plane L-L and is disposed to the side of plane L-L toward the end 112*b* of the lamp. The lamp electronics 110 including board 80 may also be on the opposite side of plane L-L from base 102 such that a portion of the lamp electronics 110 and/or board 80 may extend into the volume defined by the enclosure 112. Thus, the internal space 113 and lamp electronics may extend from the base side of plane L-L to the opposite enclosure side of plane L-L.

The optical element 200 is designed to extend over the sides of the LED 127 and at least the portion of the heat sink 149 that extends beyond plane L-L and into the volume defined by the enclosure 112. The optic element 200 comprises a first portion that extends to the first side of the plane P-P and a second portion that extends to the second side of the plane P-P.

In one embodiment the optic element 200 includes a first portion or base 206 that extends over and covers the components that extend into the volume defined by enclosure 112 and a second portion or stem 201 that extends into the center of the enclosure and that includes the light emitting portion 202 that corresponds to the glowing incandescent filament in a traditional incandescent bulb. In one embodiment, the base 206 is configured such that it extends from adjacent the lower end 112*a* of the enclosure 112 and encircles the upper portion of the heat sink 149, LED 127 and LED board 130 that extend into the volume defined by the enclosure 112. The second portion 208 may comprise a relatively long narrow member that extends along the longitudinal axis A-A of the lamp.

In one embodiment the upper portion of the heat sink 149 has raised platform 210 having a LED support surface 212 that is positioned to the side of plane L-L opposite base 102 for supporting the LEDs. In the illustrated embodiments the support surface 212 is disposed transversely to the longitudinal axis of the lamp substantially on the plane P-P; however, the support surface may have other orientations and may be located at any position at or above plane P-P. The heat sink 149 has a downwardly extending rim 208 that extends toward base 102. An annular flange 210 extends from the end of rim 208 that is configured and dimensioned to be closely received in the second portion of the heat sink 154 such that the platform 210 is centered in the enclosure 112 and is spaced from the enclosure such that an annular space 214 is provided that surrounds the platform 218. In the illustrated embodiment the platform 218 is formed by the first portion 152 of the heat sink. In other embodiments the platform 210 may be formed in other manners.

The base 206 of the optic element 200 has a first surface 218 that extends over and covers the LED 127, LED board 130 and platform 206. A rim 220 extends from the first surface 218 that covers the rim 208 of the platform and that fits into the annular space 212 formed between the platform and the enclosure 112. The base 206 defines the bottom of the optically transmissive enclosure and divides the interior space of the enclosure 112 from the base 102. As is shown in the drawings the optic element 200 and the upper portion of heat sink 149 extend from the lower end 112*a* of the enclosure 112 and extend beyond line L-L into the interior space of the enclosure 112 to effectively increase the space available to house the LED 127, LED board 130, heat sink and lamp electronics 110. The arrangement described herein allows the size of the non-optically transmissive base 102 of the lamp to be reduced relative to the optically transmissive enclosure 112 such that the lamp of the invention provides a greater ratio of optically transmissive view space to non-optically transmissive base. By extending the optic element 200 and the enclosure behind the plane P-P of the LED 127, the joint between the optically transmissive enclosure 112 and the non-optically transmissive base 102 may be moved toward the base 103 behind the plane P-P of the LED 127 to thereby increase the ratio of optically transmissive view space to non-optically transmissive base. Because the optic element 200 is made of an optically transmissive material and the base of the optic element 200 extends to the end 112*a* of the enclosure 112, light may be projected from the optic element over the entire area of the enclosure 112 such that the extension of the interior space 113 into the enclosure 112 does not inhibit light emitted from the enclosure and does not create dark spots on the enclosure.

The filament portion 208 of the optic element 200 extends into the center of the enclosure 112 such that the light emitted from the filament portion 208 glows to mimic the light pattern of an incandescent candelabra bulb. The filament portion 208 may have any suitable shape and may emit light in a variety of patterns. While the optic element has been described as a generally cylindrical member having a diameter, the optic element may be other than a cylinder such that the "diameter" of the optic element may be considered a transverse distance or width. The term "width" as used herein means a diameter in a cylindrical optic element and/or a transverse dimension in a non-cylindrical optic element. In one embodiment the filament portion 208 may have a width of approximately 3-5 mm. In one embodiment the stem 201 of the optic element 200 is formed as a relatively long, thin member that is disposed along the longitudinal axis of the lamp. The optic element 200 may be formed such that the stem 201 has a width of approximately 5 mm or less and in some embodiments may be 3-5 mm in diameter. The stem 201 may be formed with a slight taper where the light emitting portion has a width of approximately 5 mm or less at the distal termination end of the stem 201 where the stem gradually widens toward base 206. In one embodiment the stem 201 has a width of approximately 5 mm and a width of approximately 3 to 5 mm at the end of the light emitting portion 202. In some embodiments, the optic element 200 has an overall height of about 33-34 mm and the stem has a height of approximately 22 mm. In order to create the visual effect of a candelabra the height to width ratio of the stem may be at least 2:1. The height to width ratio may be between 2:1 and 8:1 and in one embodiment the ratio may be approximately 6.5:1. The height to width ratio of the stem may be at least 3:1, 4:1, 5:1 or the like. The distal end of the optic has a width of approximately 3-4 mm with the element tapering from a width of approximately 5 mm near the midpoint of the stem 201 to a width of approximately 3 mm at the distal end 203 of the optic element. The optic element may gradually increase in width from the distal end 203 to the base from approximately 3 mm to approximately 10-10.5 mm. The width of the base 206 may be approximately 32 mm. The stem 201 may narrow at an angle of 0-10 degrees with a preferred angle between 3 and 5 degrees and in one embodiment approximately 4 degrees. The width of the base 206 may be approximately three times, five times, six times or greater the width of the stem 201. The width of the base 206 may be approximately between three times and 10 times the width of the stem 201. The stem 201 may have a height of approximately between approximately 21 and 23 mm and in one embodiment approximately 22 mm. In some embodiments the height of the stem between the point of intersection with the base and the distal end of the optic element and the width of the stem at the distal end may have a height to width ratio of at least 3:1 and may approximately between 3:1 and 8:1 and in some embodiments may be approximately 7:1. These are just examples to illustrate exemplary dimensions and relative scale but other dimensions and the relationship between the dimensions may be different from those described with respect to specific embodiments. The use of a relatively long, narrow light emitting portion provides a visible light pattern that is similar to the visible light pattern in a fluorescent candelabra bulb. A LED based lamp as described herein emits light having a color temperature of between 1500K and 2700K. In other embodiments the color temperature may be between 2700K and 6500K.

The underside of the base 206 of the optic element 200 may have a light entry surface 230 for receiving light emitted by the LED 127. In one embodiment the LED 127 comprising a single light emitting surface as previously described and the light entry surface 230 are centered in the optical element. The use of a single light emitting surface is better able to couple to the optic element than multiple light emitting surfaces. In some embodiments the width of the light emitting surface is the same or smaller that the width of the light entry surface 230. As used herein width means the largest transverse dimension of the component. For example, the width of the circular light entry surface 230 may be a diameter and the width of the LED 127 may be a diameter, diagonal or a transverse width. In the present example the LES of the LED 127 is approximately 4.6 mm while the diameter of the light entry surface is approximately 6.6 mm. Thus, the single LES may be located completely within the footprint of the light entry surface such that good optical coupling is provided. The light entry surface 230 may shape the light entering the optic element. The entry surface 230 may be surrounded by an annular guide 232 that guides most of the light emitted from the LED 127 to the filament portion 208. However, because the optic element 200 is made of an optically transmissive material, a portion of the light from the LEDs will enter the optic element 200 and be emitted from the base 206 as side light and/or back light. In some embodiments the optic element 200 arranged as described herein provides 6-10% more downlight than a LED disposed at the end of the enclosure 112. "Downlight" means light directed toward base 102.

In one embodiment, the light may be emitted with a periodic or aperiodic oscillation of intensity to mimic the flicker of a gas and/or candle flame. The light may be provided with a frequency of amplitude change in the range of approximately 5 and 60 Hz. The pseudo-random or periodic modulation of the light amplitude may be provided using a linear-feedback shift register or a microcontroller to generate a modulation signal.

In one embodiment, the LED 127 may be controlled to control the color of the light emitted from the optic element 200. In one embodiment, the light is controlled such the light emitted from the optic element 200 may be, under certain operating conditions, red/orange/red-orange in color. Software may be used to shunt current to and from selected LED 127 to control the color of the light emitted by the LED assembly 120. In one embodiment, the color of the light may be changed from essentially white light to red/orange/red-orange light when a user lowers the current delivered to the LED power supply 110. In one embodiment a dimmer switch may be provided to control the current delivered to the LED power supply. The dimmer switch may be provided in the electrical path and may be part of the fixture with which the lamp 100 is used or it may be located remotely from the fixture such as on a wall as is typical of a standard light switch. When the current delivered to the LED power supply 110 falls below a predetermined value, the power supply software shunts the current to desired LED 127 to change the color of the light emitted from the LED assembly 120. By making the color change to red/orange/red-orange when the current is lowered (such as in response to a user controlled dimmer switch) the optic element 200 can be made to glow red-orange in the area of the light emitting area 202 to simulate the look of a dimmed incandescent bulb. In some embodiments, the color may change as the current passes predetermined levels. For example, at a first current level the color may change to red-orange and at a second current level the color may change to orange and at a third current level the color may change to white. As the current level rises the lumens output by the LED 127 may also increase such that the brightness of the lamp increases as the color changes.

In some embodiments a wireless module 600 may be provided in the lamp (FIG. 5) for receiving, and/or transmitting, a radio signal or other wireless signal between the lamp and a control system and/or between lamps. The wireless module 600 and related smart technologies may be used in any embodiments of the lamp as described herein. The wireless module 600 may convert the radio wave to an electronic signal that may be delivered to the lamp electronics 110 for controlling operation of the lamp. The wireless module may also be used to transmit a signal from the lamp. The wireless module 600 may be positioned inside of the enclosure 112 such that the base 102 including Edison screw 103 do not interfere with signals received by or emitted from wireless module 600. The wireless module 600 may be provided with an internal antenna. The antenna may be located in the enclosure 112 and/or base 102. The antenna may also extend entirely or partially outside of the lamp. In various embodiments described herein various smart technologies may be incorporated in the lamps as described in the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," application Ser. No. 61/932,058, filed Jan. 27, 2014, which is incorporated by reference herein in its entirety.

In some embodiments color control is used and RF control circuitry for controlling color may also be used in some embodiments. The lamp electronics may include light control circuitry that controls color temperature of any of the embodiments disclosed herein in accordance with user input such as disclosed in U.S. patent application Ser. No. 14/292,286, filed May 30, 2014, entitled "Lighting Fixture Providing Variable CCT" by Pope et al. which is incorporated by reference herein in its entirety.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A LED candelabra comprising;

a non-optically transmissive lamp base having an upper end;

an optically transmissive enclosure having a lower end connected to the upper end of the lamp base;

a LED assembly for emitting light when energized through an electrical path from the lamp base, the LED assembly disposed on a support surface positioned beyond the upper end of the lamp base in the optically transmissive enclosure such that the LED assembly is positioned at a plane that extends substantially transverse to a longitudinal axis of the candelabra and through the optically transmissive enclosure;

the lower end of the optically transmissive enclosure extending across the plane to a first side of the plane facing the lamp base;

an optic element in the enclosure for receiving the light emitted by the LED assembly, the optic element comprising an exposed first portion that extends to the first side of the plane and a second portion that extends to a second side of the plane for transmitting light from a light emitting portion.

2. The LED candelabra of claim 1 wherein the lamp base comprises an Edison base.

3. The LED candelabra of claim 1 wherein the light emitting portion comprises surface treatment on the optic element.

4. The LED candelabra of claim 1 wherein where the light emitting portion is configured to visually appear like a filament in a traditional bulb.

5. The LED candelabra of claim 1 comprising a heat sink, the LED assembly being thermally coupled to the heat sink.

6. The LED candelabra of claim 5 wherein the heat sink defines a cavity for receiving lamp electronics, the lamp electronics being in the electrical path.

7. The LED candelabra of claim 6 wherein the optically transmissive enclosure is connected to the lamp base at a second plane that is disposed transverse to the longitudinal axis.

8. The LED candelabra of claim 7 wherein a portion of the heat sink and a portion of the lamp electronics extend from the lamp base beyond the second plane.

9. The LED candelabra of claim 7 wherein an upper portion of the heat sink extends beyond the upper end of the lamp base.

10. The LED candelabra of claim 6 wherein the optic element extends over the LED assembly and at least a portion of the heat sink.

11. The LED candelabra of claim 10 wherein the portion of he heat sink comprises the support surface.

12. The LED candelabra of claim 11 wherein a portion of the optic element is disposed between the LED support surface and the enclosure.

13. The LED candelabra of claim 1 wherein the enclosure defines an interior space and the optic element divides the interior space of the enclosure from the lamp base.

14. The LED candelabra of claim 1 wherein a portion of the enclosure extends from the first side of the plane to the second side of the plane.

15. A LED lamp comprising;

a non-optically transmissive lamp base;

an optically transmissive enclosure having a distal end and a lower end connected to the lamp base to divide the candelabra into an optically transmissive portion and a non-optically transmissive portion where a first plane separates the optically transmissive portion from the non-optically transmissive portion;

a LED assembly for emitting light when energized through an electrical path from the lamp base arranged on a platform disposed to a first side of the first plane in the optically transmissive portion, the LED assembly defining a second plane disposed generally parallel to the first plane where a first side of the second plane faces the distal end of the optically transmissive enclosure and a second side of the second plane faces the lamp base, the electrical path including lamp electronics;

an optic element in the enclosure for receiving the light emitted by the LED assembly, the optic element comprising an exposed first portion and an exposed second portion, the second portion comprising a distal end that extends to the first side of the first plane and to the first side of the second plane and the first portion extending to the second side of the second plane where at least a portion of the first portion is on the second side of the first plane;

a cavity defined at least in part by the platform, the cavity disposed at least partially in the lamp base for receiving the lamp electronics, the cavity extending from the first side of the plane beyond the plane to a second side of the plane.

16. The LED lamp of claim 15 comprising a heat sink comprising the platform, the LED assembly being thermally coupled to the heat sink, wherein the heat sink defines the cavity for receiving the lamp electronics.

17. The LED lamp of claim 16 wherein the optic element extends over the LED assembly and at least the portion of the heat sink.

18. The LED lamp of claim 17 wherein the platform comprises a LED support surface for supporting the LED assembly and a portion of the optic element is disposed between the LED support surface and the enclosure.

19. The LED lamp of claim 15 wherein enclosure defines an interior space and the optic element divides the interior space of the enclosure from the lamp base.

20. A LED candelabra comprising;

a lamp base;

a LED assembly for emitting light when energized through an electrical path from the lamp base, the LED assembly comprising an outer periphery, the LED assembly defining a first transverse plane;

an optically transmissive enclosure defining a distal end of the lamp, the optically trasnmissive enclosure being connected to the lamp base to divide the candelabra into an optically transmissive portion and a non-optically transmissive portion at a second transverse plane where the lamp base and enclosure define a longitudinal axis extending from the lamp base to the distal end of the lamp, the LED assembly disposed in the optically transmissive portion;

an optic element in the enclosure for receiving the light emitted by the LED assembly, the optic element comprising an exposed stem extending along the longitudinal axis and having a first width and an exposed base having a second width where the second width is at least three times greater than the first width, the optic element extending across the first transverse plane and the second transverse plane from the optically transmissive portion to the non-optically transmissive portion where the base of the optic element surrounds the outer periphery of the LED assembly.

21. The LED lamp of claim 20 herein the second width is approximately between three times and 10 times the first width.

22. The LED lamp of claim 20 wherein the stem has a height, the height of the stem and the width of the optic element at the distal end may have a height to width ratio of at least 2:1.

23. The LED lamp of claim 20 wherein a light emitting portion is formed on the stem.

24. The LED lamp of claim 20 wherein the stem has a width of less than 5 mm at a distal end of the stem.

25. The LED lamp of claim 20 wherein the single SMD LED has a single light emitting surface.

26. The LED lamp of claim 20 wherein the lamp produces a CRI≥90 and a R9 value≥40.

27. The LED lamp of claim 20 wherein the lamp emits light having a color temperature of between 1500K and 6500K.

28. The LED lamp of claim 20 wherein the single SMD LED component is centered relative to the optical element.

29. The LED lamp of claim 20 wherein the light is emitted with one of a periodic and aperiodic oscillation of intensity.

30. The LED lamp of claim 29 wherein the oscillation of intensity has a frequency of amplitude change in the range of approximately 5 and 60 Hz.

31. The LED lamp of claim 20 wherein the stem has a height, the height of the stem and the width of the optic element at the distal end may have a height to width ratio of approximately 2:1 to 8:1.

32. The LED lamp of claim 20 wherein the stem terminates in an end face and a recess is formed in the end face.

33. The LED lamp of claim 20 further comprising a wireless module for receiving a radio signal.

34. The LED lamp of claim 20 further comprising a wireless module for transmitting a radio signal.

* * * * *